US009133994B2

(12) United States Patent
Dowdy et al.

(10) Patent No.: US 9,133,994 B2
(45) Date of Patent: Sep. 15, 2015

(54) EXTENDED REACH RECHAREGABLE LIGHTING SYSTEMS

(75) Inventors: Randal A. Dowdy, Bedford, TX (US); Tracy J. Dowdy, Bedford, TX (US); Justin D. Pendleton, The Colony, TX (US)

(73) Assignee: VERSALITE ASSOCIATES, LLC, Bedford, TX (US)

( * ) Notice: Subject to any disclaimer, the term of this patent is extended or adjusted under 35 U.S.C. 154(b) by 680 days.

(21) Appl. No.: 13/471,628

(22) Filed: May 15, 2012

(65) Prior Publication Data

US 2012/0293068 A1 Nov. 22, 2012

Related U.S. Application Data

(60) Provisional application No. 61/487,268, filed on May 17, 2011.

(51) Int. Cl.

| | |
|---|---|
| ***H05B 41/26*** | (2006.01) |
| ***F21S 8/04*** | (2006.01) |
| ***F21S 9/02*** | (2006.01) |
| ***H05B 37/00*** | (2006.01) |
| *F21V 17/10* | (2006.01) |
| *F21W 131/304* | (2006.01) |

(52) U.S. Cl.

CPC .... *F21S 8/04* (2013.01); *F21S 9/02* (2013.01); *H05B 37/00* (2013.01); *F21V 17/105* (2013.01); *F21W 2131/304* (2013.01)

(58) Field of Classification Search

CPC ..... F21S 8/04; F21S 9/02; H05B 37/00; F21W 2131/304; F21V 17/105

See application file for complete search history.

(56) References Cited

U.S. PATENT DOCUMENTS

| | | | |
|---|---|---|---|
| 3,786,575 | A | 1/1974 | Riblett |
| 4,001,571 | A | 1/1977 | Martin |

(Continued)

FOREIGN PATENT DOCUMENTS

| | | | |
|---|---|---|---|
| JP | 405190007 | A | 7/1993 |
| WO | 2006086308 | | 8/2006 |

OTHER PUBLICATIONS

Fraen Srl FT3 Lens Series Brochsures, Fraen Corporation, Reading, MA, Nov. 30, 2003, 6pp. (Copy attached).

(Continued)

*Primary Examiner* — Tuyet Vo
*Assistant Examiner* — Henry Luong
(74) *Attorney, Agent, or Firm* — Workman Nydegger

(57) ABSTRACT

Lighting systems for remote placement and powering of a lighting device. The lighting systems include a lighting device for placement on a wall or ceiling and an external power supply selectively attachable to and detachable from the lighting device. The lighting device includes a power receiving structure that receives power from the external power supply and delivers electrical power to a rechargeable battery and/or light source. The external power supply includes a corresponding power delivery structure that delivers power to the power receiving structure of the lighting device. The power receiving and delivery structures may constitute an inductive power transfer system composed of one or more batteries or capacitors, a DC-to-AC inverter, electromagnetic power transfer and receiving coils, and an AC-to-DC convertor or rectifier. Alternatively, the power receiving and delivering structures may constitute direct electrical contacts.

19 Claims, 6 Drawing Sheets

(56) References Cited

U.S. PATENT DOCUMENTS

| | | | |
|---|---|---|---|
| 4,682,078 | A | 7/1987 | Pascalide |
| 4,712,167 | A | 12/1987 | Gordin |
| 4,841,278 | A | 6/1989 | Tezuka |
| 5,003,432 | A | 3/1991 | Mandy |
| 5,165,783 | A | 11/1992 | Barron, Sr. |
| 5,526,245 | A | 6/1996 | Davis |
| 5,617,079 | A | 4/1997 | Harrison |
| 5,772,309 | A | 6/1998 | Groben |
| 5,934,787 | A | 8/1999 | Sharma |
| 6,140,934 | A | 10/2000 | Lam |
| 6,364,510 | B1 | 4/2002 | Bernhart |
| 6,604,842 | B2 | 8/2003 | Griffiths |
| 6,652,115 | B2 | 11/2003 | Sharrah |
| 6,744,223 | B2 | 6/2004 | Laflamme |
| 6,798,167 | B1 | 9/2004 | Canino |
| 6,953,260 | B1 | 10/2005 | Allen |
| 7,011,435 | B1 | 3/2006 | Blaymore |
| 7,027,736 | B1 | 4/2006 | Mier-Langner |
| 7,772,801 | B2 | 8/2010 | Dowdy |
| 2005/0243549 | A1 | 11/2005 | Ruston |
| 2006/0176689 | A1* | 8/2006 | Dowdy et al. ..... 362/188 |
| 2011/0001455 | A1* | 1/2011 | Dowdy et al. ..... 320/107 |

OTHER PUBLICATIONS

Market Analysis Report, LJM Associates, Manhattan Beach, CA, May 5, 2005, pp. 5-8 (Copy attached).
Luxeon Technical Data Sheet DS47, Lumileds Lighting, US, LLC, San Jose, CA, 12p., Sep. 19, 2004 (Copy attached).
International Search Report, PCT/US06/04110,dated Jan. 28, 2008 (Copy attached).
U.S. Appl. No. 11/345,814, filed Jul. 26, 2007, Office Action.
U.S. Appl. No. 11/345,817, filed Jan. 30, 2008, Office Action.
U.S. Appl. No. 11/345,817, filed Sep. 8, 2008, Office Action.
U.S. Appl. No. 11/345,817, filed Jun. 19, 2009, Notice of Allowance.
U.S. Appl. No. 12/567,468, filed Mar. 24, 2010, Notice of Allowance.

* cited by examiner

EXTENDED REACH RECHAREGABLE LIGHTING SYSTEMS

CROSS-REFERENCE TO RELATED APPLICATIONS

This application claims the benefit of U.S. Provisional Application No. 61/487,268, filed May 17, 2011, entitled "RECHARGEABLE LIGHT AND RECHARGING APPARATUS," the disclosure of which is incorporated herein in its entirety.

BACKGROUND

1. Field of Invention

The invention relates to rechargeable lighting systems, including remotely located lighting systems that are beyond the reach of a person.

2. Technology Review

Many people attempt to make their homes appear warmer and more attractive by installing professional styled lighting fixtures, such as to illuminate paintings, prints, photographs, awards, artifacts, plants, flowers, or aquariums. A house is typically wired to provide electrical power to ceiling- or wall-mounted lighting devices. In the event a house is not prewired for such lighting in a particular location and it would be intrusive, expensive or inconvenient to rewire the house for that location, it may be desirable to install battery operated lights.

Although battery-powered lighting devices have been proposed, they have not been commercially successful due to poor light quality, which is often linked to power constraints, issues with battery life, and the inconvenience of replacing or recharging the batteries. It is especially inconvenient to replace or recharge batteries that are beyond reach. Such devices require a ladder or chair to reach and access the rechargeable battery.

One solution to this problem is described in U.S. Pat. No. 7,604,370 to Dowdy et al. and U.S. Pat. No. 7,772,801 to Dowdy et al. ("Dowdy patents"), which disclose battery recharging systems for hard to reach lighting devices and which are incorporated herein by reference. While the Dowdy patents may provide a solution to the basic problem of recharging hard to reach battery powered lighting devices, the inventors have identified additional problems and needs, which remain unsolved and unmet in the art. For example, decorative lighting devices remain obtrusive, with low aesthetic appeal, particularly if a recharging unit is attached to the lighting device.

BRIEF SUMMARY

The present invention provides remote lighting systems with improved aesthetic appeal and functionality. More particularly, a lighting system for remote placement and powering of a lighting device is provided which is comprised of a lighting device and an external power supply selectively attachable to and detachable from the lighting device. The lighting device includes power receiving means for receiving power from the external power supply, which is provided to at least one of a rechargeable battery, capacitor or light source of the lighting device. The external power supply includes corresponding power delivery means for delivering power to the power receiving means of the lighting device.

According to one embodiment, the power receiving means of the lighting device comprises an inductive power receiver including an electromagnetic power receiver coil for generating AC power in response to electromagnetic power from an external power supply and an AC-to-DC converter (e.g., rectifier) electrically coupled to the electromagnetic power receiver coil, which converts AC power to DC power. The DC power can be delivered to the rechargeable battery and/or capacitor of the lighting system and/or the light source.

According to another embodiment, the power delivery means of the external power supply for delivering power to the power receiving means of the lighting device comprises a DC-to-AC inverter in electrical communication with a rechargeable battery (or high capacity capacitor) and an electromagnetic power generator coil in electrical communication with the DC-to-AC power inverter.

When the external power supply is positioned adjacent to the lighting device in a predetermined position, electromagnetic power produced by the external power supply induces AC power in the power receiving means of the lighting device. The AC power is converted to DC power in order to recharge a rechargeable battery or capacitor and/or provide electrical power to the light source. The external power supply can be used to recharge an onboard battery or capacitor of the lighting system or it can be used as supplemental power for the light source instead of or in addition to the onboard battery or capacitor.

The external power supply can be selectively attachable to and detachable from the lighting device by means of one or more magnets on or in the external power supply and/or lighting device. In this way, the lighting device can have a smooth, aesthetically appealing exterior surface that is free from obtrusive or unattractive hooks, plugs, sockets, protrusions or recesses. The external power supply can have a shape that complements the shape of a sconce body of the lighting device in order to provide an aesthetically appealing lighting system even with the external power source attached to the lighting device.

The external power supply can include an adaptor to receive DC power from an external power source, such as an AC/DC wall adaptor with common DC plug or USB adaptor, in order to recharge an external battery of the external power supply. An extension pole can be provided that is selectively attachable to and detachable from the external power supply (e.g., by a mechanical connection, such as by one or more protrusions, recesses, spring loaded features, and/or magnets). The extension pole provides a user with easy access to the external power supply even if the lighting device is located in a remote location out of the user's reach.

A second or auxiliary external power supply can be attached to the lighting device in order to provide additional charging capability of an onboard rechargeable battery or capacitor and/or as a source of additional power in addition to a first external power supply. Both can be placed against an exposed surface of the lighting device sconce in order to provide a balanced and appealing look.

In an alternative embodiment, the power receiving means of the lighting device and the power delivery means of the external power supply may comprise direct electrical contacts (e.g., positive and negative contacts that are in electric communication with a respective battery and/or capacitor). According to one embodiment, the positive and negative contacts of the lighting device can be provided by different faces or regions of the sconce body, which are electrically isolated from each other. The positive and negative contacts of the external power supply can be provided by corresponding faces or regions of the external power supply body, which are electrically isolated from each other. In this way, positive and negative contacts can be provided that do not look like electrical contacts but rather blend in with the ornamental features of the lighting device and external power supply without compromising the aesthetic appeal of the lighting system.

According to one embodiment, the light source can be positioned within a fixture that is pivotally attached to the sconce body of the lighting device so as to provide for angular adjustment of the light source. In this way, a desired lighting angle can be provided by the user.

These and other advantages and features of the invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION OF EXEMPLARY EMBODIMENT

Figure 1:
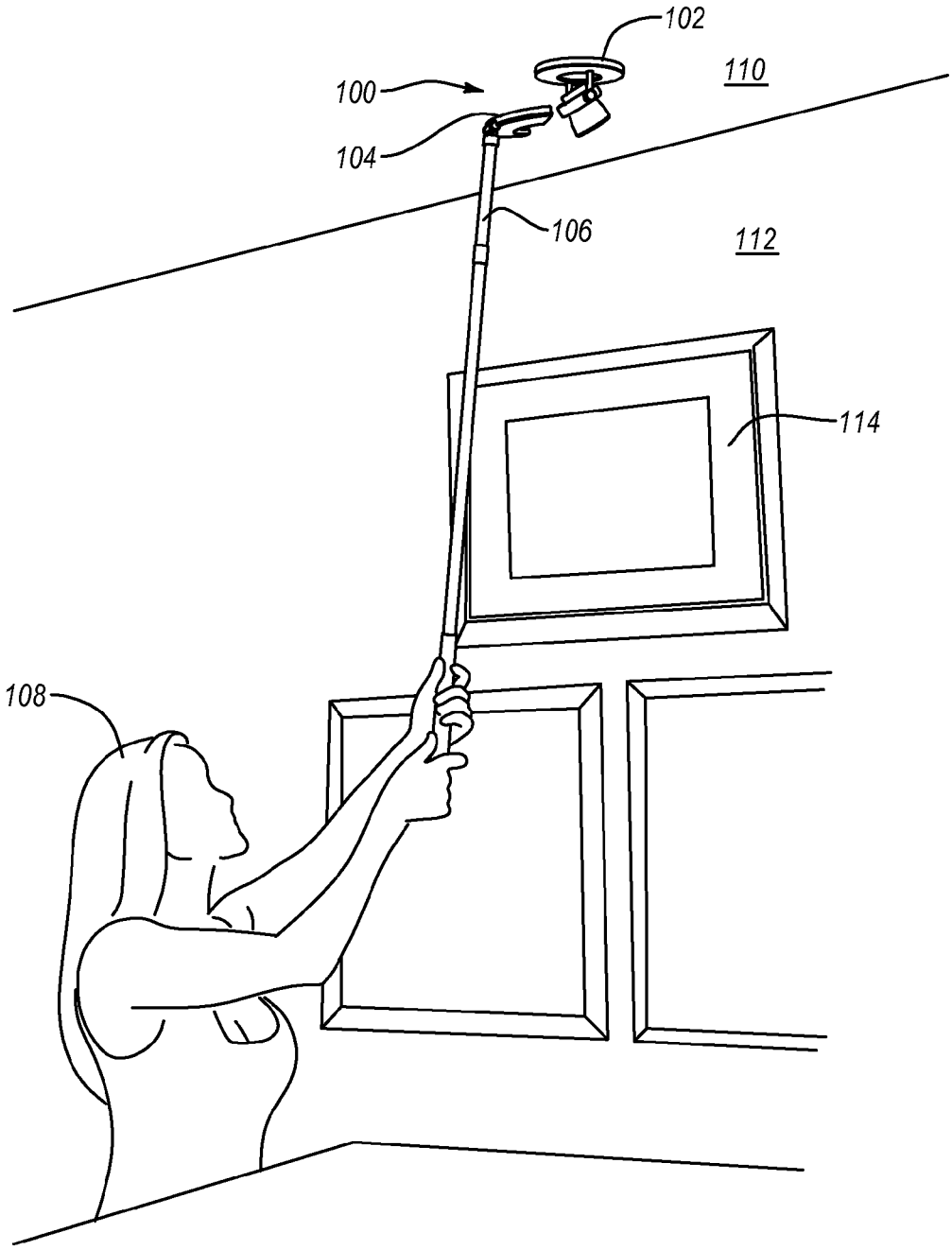
FIG. 1 illustrates a remote lighting system according to an embodiment of the disclosed invention with a person in the act of attaching or removing an external power supply to the lighting device.

The disclosed lighting systems for remote placement and powering of a lighting device is comprised of a lighting device and an external power supply selectively attachable to and detachable from the lighting device. The lighting device includes power receiving means for receiving power from the external power supply and delivering electrical power to at least one of a rechargeable battery or a light source. The external power supply includes corresponding power delivery means for delivering power to the power receiving means of the lighting device.

Embodiments of lighting systems as disclosed herein provide one or more of the following features. An external power supply can be selectively attached to and detached from a remotely located rechargeable lighting device. The lighting system may include smooth, aesthetically appealing outer surfaces free of unattractive protrusions, sockets or physical electrical contacts. For example, magnetic attachment between the external power supply and lighting device can eliminate elongated fingers or other aesthetically obtrusive or unappealing appendages.

The external power supply can be a battery (e.g., a rechargeable battery that has a higher voltage and capacity than an onboard battery of the lighting device). Alternatively, external and/or on board power storage can be provided by one or more capacitors (e.g., super/ultra capacitors). Corresponding circuitries within the external power supply and lighting unit facilitate recharging or powering by induction. The external power supply includes a battery that can be charged using a charging station (e.g., a wall mount charging brick, docking station, wall charger with DC plug or USB adaptor, AC-DC plug plugged into an electrical outlet and communicating with the battery via charging contacts located on the pole member or a DC outlet in a side of the power supply body). AC power can be alternatively transferred from a standard wall outlet to the external power supply that includes a self-contained transformer (e.g., via a cord or wire passing through an extension pole). The external power supply can be left in place on a remotely located lighting device to extend operational time (e.g., by providing an auxiliary stored power source). Alternatively, the external power supply can provide the sole source of power to the lighting device (e.g., in case onboard battery or capacitor is discharged, removed, or eliminated). A recharging indicator light on the sconce can be provided to indicate when the onboard batter or capacitor has been fully charged).

The external power supply can be detachably coupled to an extension pole to provide user access to a remotely located lighting device. A swivel or other pivotable connection between the pole and external power supply permits pivoting movement of the pole relative to external power supply instead of a rigid connection (e.g., facilitates attachment of the external power supply to a remotely located lighting device attached to a wall, pillar or other non-horizontal surface rather than a ceiling). The extension pole can be selectively disconnected from the external power supply while powering the remotely located lighting device (e.g., as a result of a mechanical and/or magnetic connection between the pole member and external power supply). The extension pole can be adjustable in length to accommodate different users and/or positions of the lighting device and/or have an ergonomic handle or other graspable feature.

The lighting system may include a remote control for operating the remotely located lighting device. Other features and aspects not specifically disclosed herein, but which may add desired functionality, are disclosed in U.S. Pat. No. 7,604,370 to Dowdy et al. and U.S. Pat. No. 7,772,801 to Dowdy et al., the disclosures of which are incorporated herein by reference.

Reference is now made to the drawings, which illustrate embodiments of lighting systems within the scope of the disclosure. FIG. 1 discloses a lighting system 100 in use within a room. The lighting system 100 includes a lighting device 102 attached to a ceiling 110. An external power supply 104 attached at the end of an extension pole 106 is shown being selectively attached to or detached from the lighting device 102 by a person 108 grasping the distal end of the extension pole 106. The lighting device 102 is positioned so that light emitted therefrom is directed toward a wall 112 on which a subject 114 (e.g., painting) to be illuminated is attached.

Figure 2A:
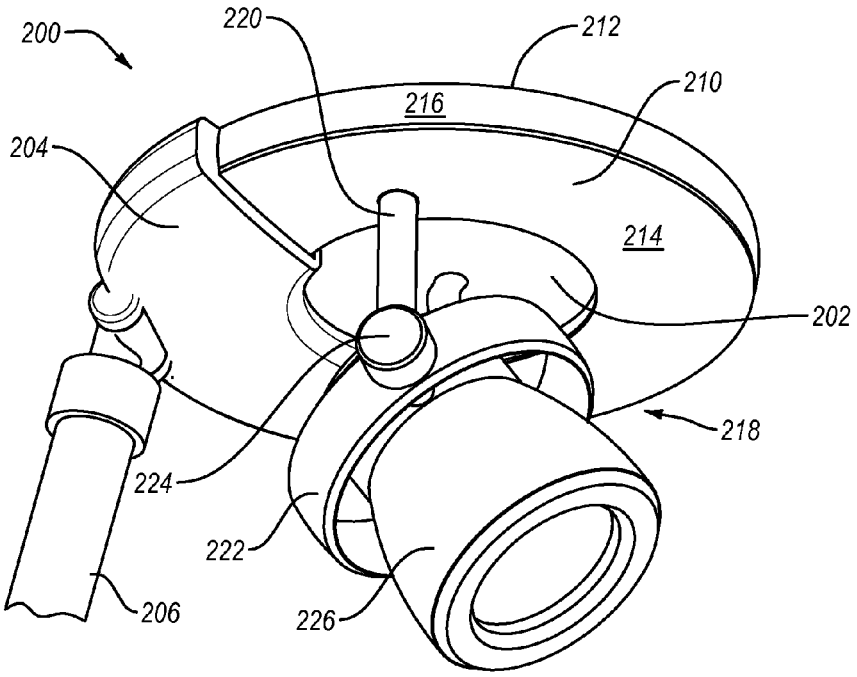
FIG. 2A more particularly illustrates a remote lighting system according to an embodiment of the disclosed invention.
Figure 2B:
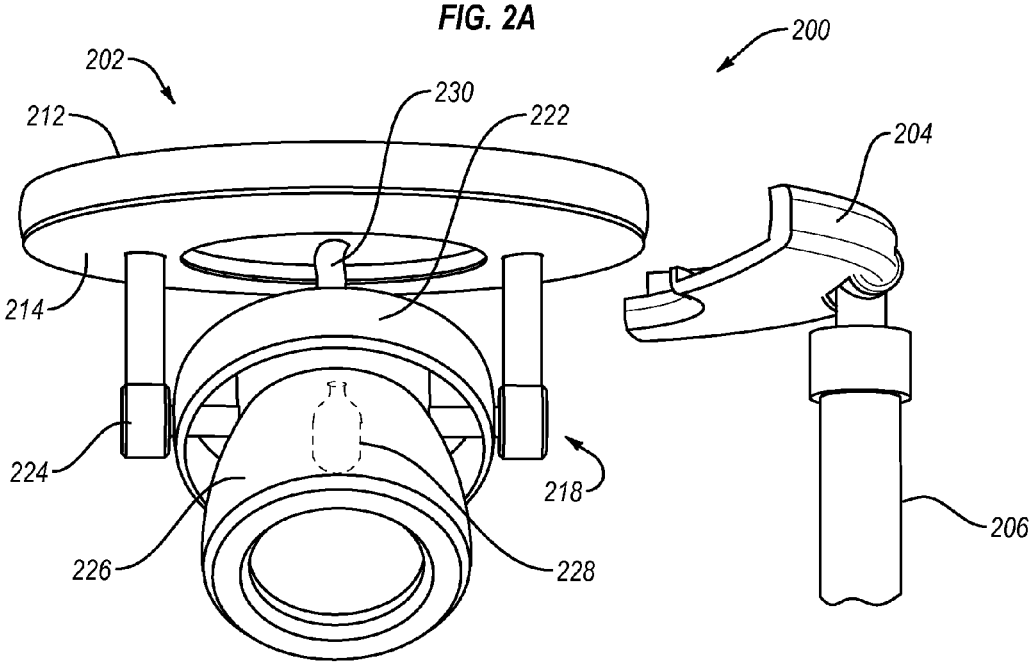
FIG. 2B is an alternative exploded view of the remote lighting system of FIG. 2A.

FIGS. 2A and 2B more particularly illustrate details of an embodiment of a lighting system 200. The lighting system 200 includes a lighting device 202 and an external power supply 204 that can be selectively attached to and detached from the lighting device 202. An extension pole 206 can be used to facilitate attachment and detachment of the external power supply 204 to and from the lighting device 202 when in a remote location (e.g., out of reach of a person).

The lighting device 202 further includes a sconce body 210, which includes a proximal side 212 for placement adjacent to a wall, ceiling or other generally flat surface. Alternatively, a lighting device may include a sconce body having a curvature or other shape that accommodates a corresponding structure to which it is to be attached. The sconce body includes an exterior surface which, in the depicted embodiment, is provided by a distal wall 214 spaced apart from the proximal side 212 and a perimeter wall 216 interconnecting and extending laterally between the proximal side 212 and the distal wall 214. According to the embodiment shown, the exterior surface provided by the distal wall 214 and perimeter wall 216 is free of hooks, sockets, plugs, protrusions, or other industrial-looking or non-aesthetically pleasing structures.

A light fixture 218 is pivotally attached to the sconce body 210 by means of a swivel bracket comprised of a pair of arms 220 fixedly attached at one end to the sconce body 210 and at another end to a ring member 222 by means of pivots 224. The ring structure 222 is rigidly attached to a shade member 226, which surrounds and protects a light source 228. The light source may comprise any light source known in the art, such as incandescent bulbs, halogen lamps, light emitting diodes (LEDs), and compact fluorescent bulbs. A power cord 230 interconnects and provides power from the sconce body 210 to the light fixture 218. The power cord 230 can be flexible and/or have a length so as to accommodate movement of the light fixture components.

Figure 3A:
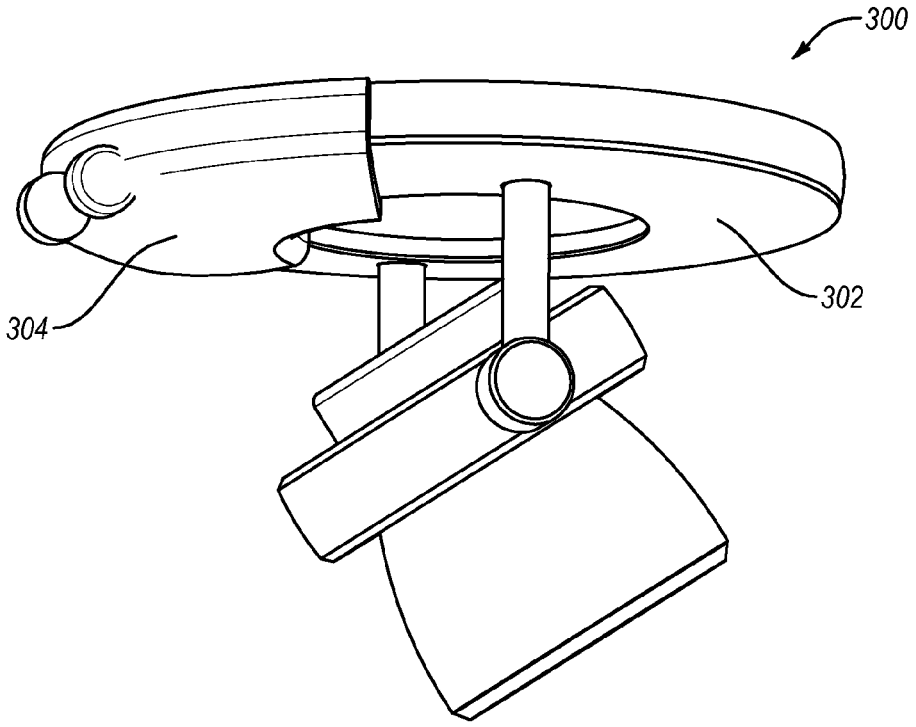
FIG. 3A illustrates an embodiment of a remote lighting system that includes one external power supply attached to a lighting device.
Figure 3B:
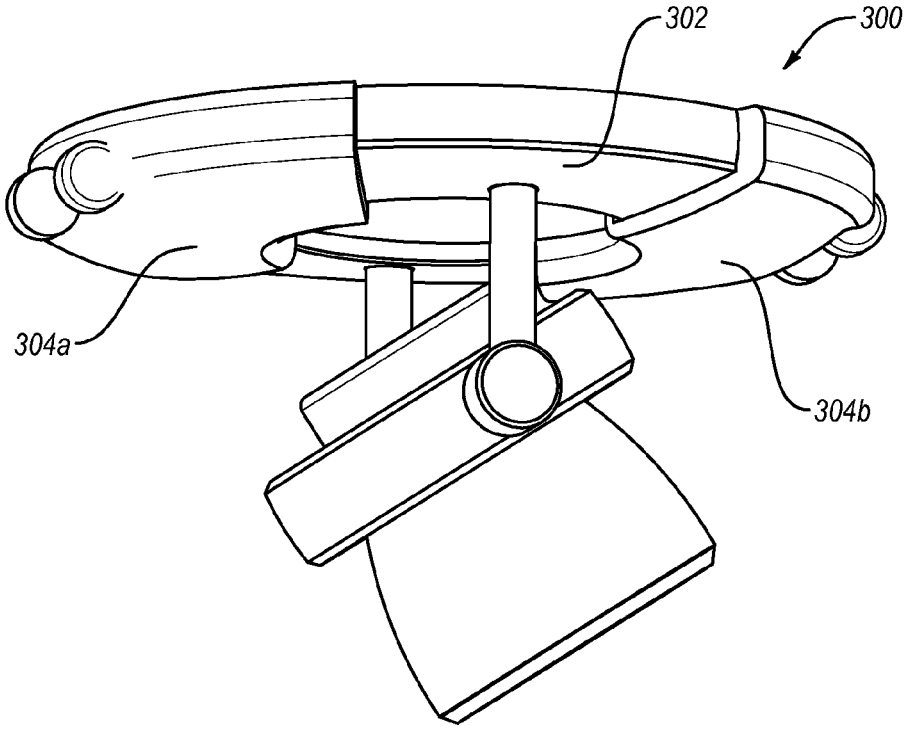
FIG. 3B illustrates an embodiment of a remote lighting system that includes two external power supplies attached to a lighting device.

FIGS. 3A and 3B illustrate lighting systems 300 with only an external power supply 304 attached to the lighting device 302 and no extension pole, cords or other obtrusive features. The combined lighting device 302 and external power supply 304 provide a smooth, nonindustrial-looking, aesthetically appealing lighting system 300 that can be used in a home, gallery or other setting where aesthetic-looking lights are essential or desired. FIG. 3A depicts lighting system 300 with a single external power supply 304 attached to the lighting device 302. FIG. 3B alternatively shows a pair of external power supplies 304*a*, 304*b* attached to the lighting device 302. Providing a pair of external power supplies 304*a*, 304*b* does not detract from the overall aesthetic appeal of the lighting system 300 and may actually provide additional balance and aesthetic appeal compared to using only one external power supply 304.

Figure 4:
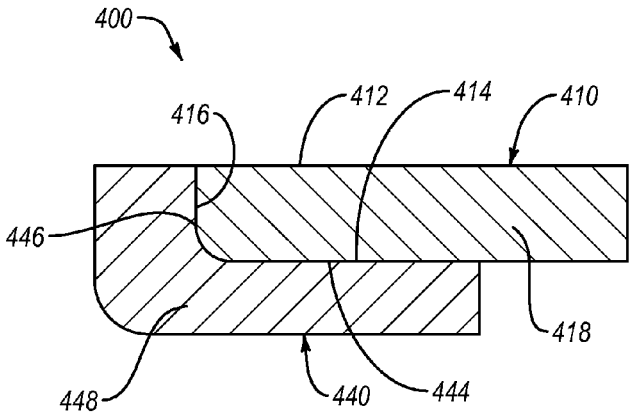
FIG. 4 schematically illustrates a close-up view of an embodiment of a remote lighting system, more particularly a external power supply in close proximity with a portion of a lighting device.

FIG. 4 schematically illustrates a close-up view of an embodiment of a remote lighting system 400 that includes a sconce body 410 and an external power source body 440 positioned adjacent thereto. The sconce body 410 includes a proximal side 412 configured for placement adjacent to a supporting structure or surface. Sconce body 410 further includes a distal wall portion 414 spaced apart from the proximal side 412 and a perimeter wall portion 416 extending laterally between and interconnecting the distal wall portion and perimeter wall portion of the sconce body 410. The sconce body 410 further includes an interior portion 418, which may house electronic components for receiving power from the external power supply body 440.

The external power supply body 440 includes a first wall 444 having a size and shape so as to lie adjacent to a portion of the distal wall portion 414 of the sconce body 410. A second wall 446 of the power supply body 440 is configured so as to lie adjacent to the perimeter wall portion 416 of the sconce body 410. To facilitate contact, the distal wall portion 414 and the perimeter wall portion 416 form an angle that corresponds to an angle formed by first and second walls 444 and 446 of power supply body 440. According to one embodiment, the distal and proximal walls 414, 416 can be substantially perpendicular (i.e., so as to have an angle of 90° or within a range of about 70° to 110°). First and second walls 444, 446 can also be perpendicular to each other so as to form an angle that is approximately 90°, or within a range of about 70° to about 110°. It will be appreciated that the outer surfaces of distal wall 414 and perimeter wall 416 form an angle of 270° when the walls 414, 416 are positioned orthogonally. Notwithstanding the foregoing, the walls of the sconce body and power supply body can have any desired angle, shape, curvature, or other structure that is able to provide a desired contact or proximity between the two. It is possible therefore for the external power supply and sconce body to form a mechanical connection. According to one embodiment, a magnet 450 can be provided on or in the power supply body 440 and/or a magnet 452 can be provided on or in the sconce body 410 in order to facilitate magnetic attraction of the two bodies when placed in close proximity.

Figure 5:
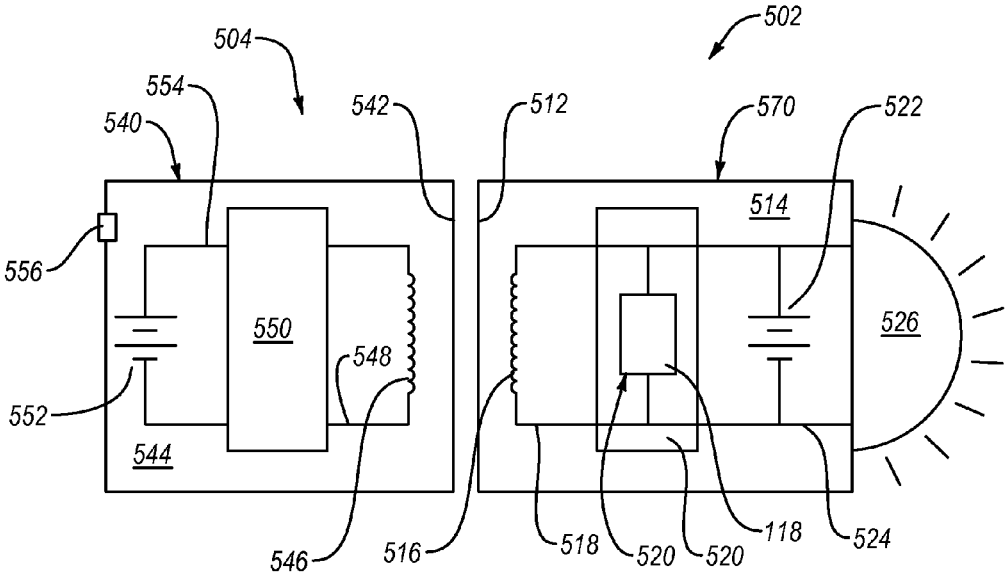
FIG. 5 schematically illustrates an inductive power transfer system that includes an electromagnetic power generator of an external power supply in close proximity to a receiver of a lighting device that receives electromagnetic power and converts it to DC power.

FIG. 5 schematically illustrates an inductive power transfer system that includes a power receiver 502 of a lighting device that receives electromagnetic power generated by an electromagnetic power generator 504 of an external power supply. The power receiver 502 and electromagnetic power generator 504 are advantageously placed in close proximity in order to maximize the efficiency of power transfer and minimize power losses.

The electromagnetic power generator 504 includes a power supply body 540 having a power transfer wall 542 and an interior portion 544. An electromagnetic power generating coil 546 is electronically coupled to a DC-to-AC power inverter 550 by means of electrical contacts or leads 548. A battery 552 is electronically coupled to the DC-to-AC power inverter by means of electrical contacts 554. A DC power socket 556 provides means for electrically coupling the battery 552 to an external power source, such as an AC-DC wall converter.

The power receiver 502 includes a power receiving body 510 (e.g., a portion of a lighting device sconce) that includes a power receiving surface 512 and an interior portion 514. An electromagnetic power receiving coil 516 is positioned near the power receiving wall 512 in order to receive electromagnetic power generated by the electromagnetic power generating coil 546 of power generator 504. The power receiving coil 516 is electronically coupled to an AC-to-DC power converter 520 (e.g., rectifier) by means of electrical contact or leads 518. The AC-to-DC power converter 520 is electronically coupled to a battery (or capacitor) 522 by means of power contacts or leads 524 and also to light source 526. In this way, the light source 526 can be powered by the battery 522, the AC-to-DC power converter 520, or both simultaneously. Alternatively, the AC-to-DC converter 520 can provide electrical power to the light source 526 in the absence of a battery (or capacitor) 522. In this case, the power supply 504 would be the only power source for the light source 526.

Figure 6:
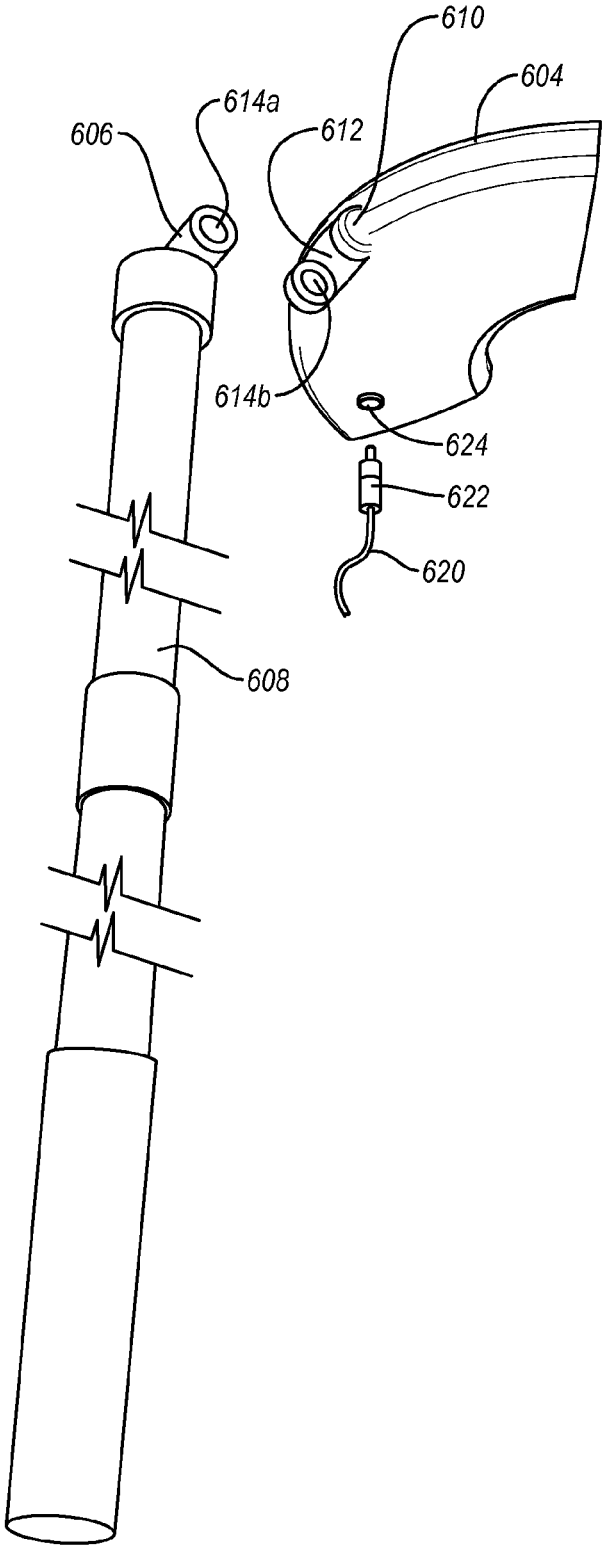
FIG. 6 illustrates an external power supply detachably coupleable to an end of an extension pole.

FIG. 6 illustrates an embodiment of an external power supply 604 detachedly couplable to an end 606 of an extension pole 608. (e.g., by means of one or more of a protrusion 610, recess 612, spring-loaded device (not shown), or magnet 614*a*, 614*b*). A pin 622 of a DC power supply cord 620 fits into a corresponding socket 624 of the external power supply 604 in order to recharge a battery (not shown) disposed therein. In this way, the external power supply 604 can be recharged when not attached to a light source, and advantageously when not attached to the extension pole 608.

Figure 7:
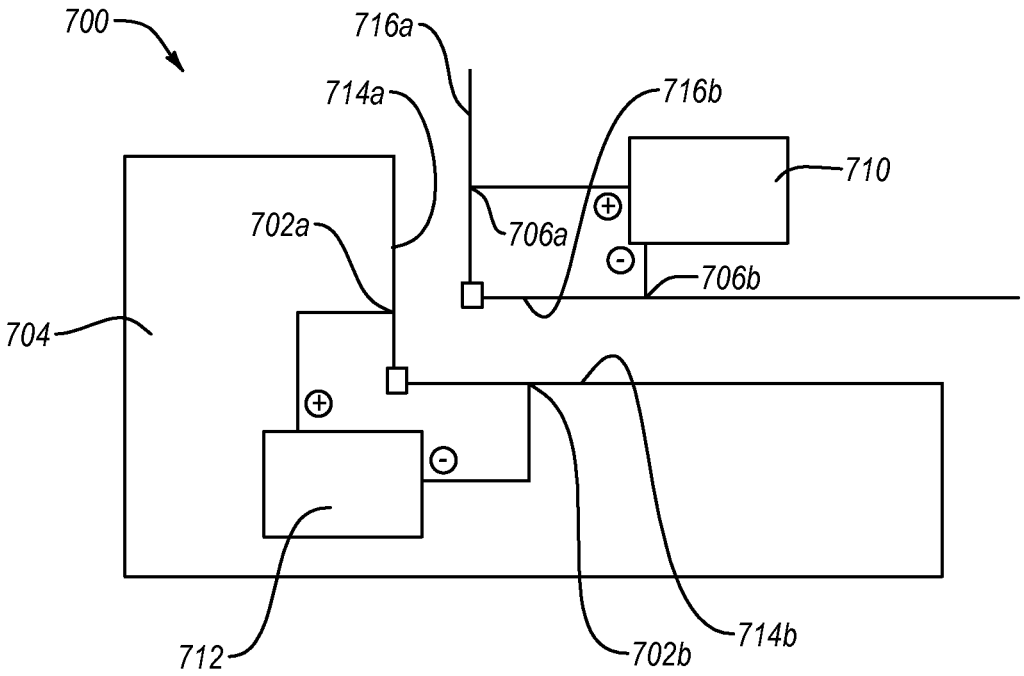
FIG. 7 schematically illustrates a direct DC power transfer system that includes positive and negative contacts of an external power supply and corresponding positive and negative contacts of a lighting device.
Figure 4:
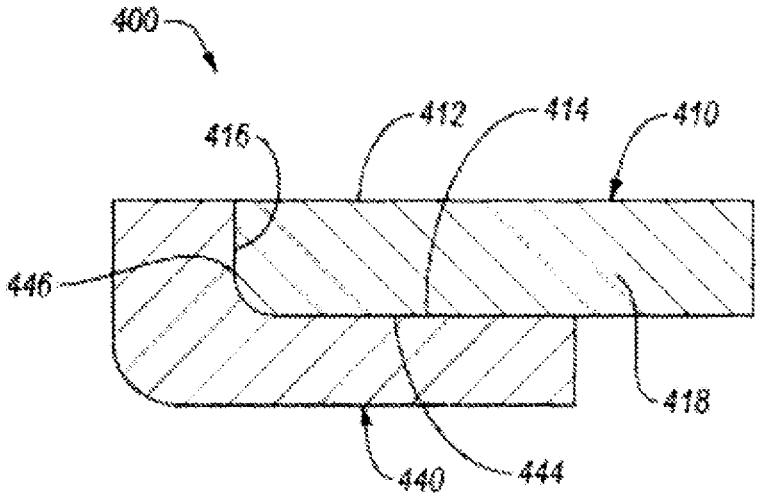
Figure 5:
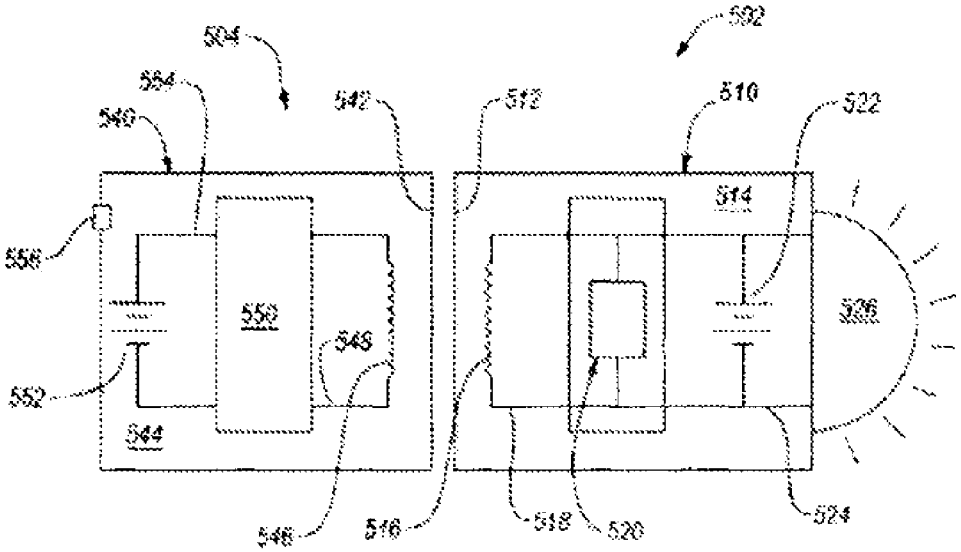
Figure 7:
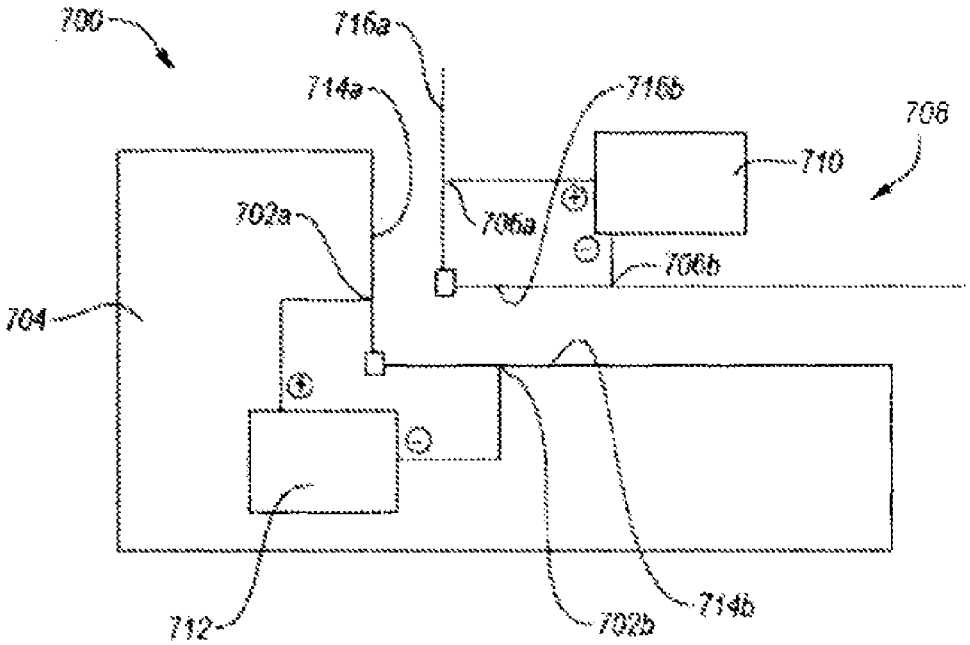

FIG. 7 illustrates an alternative embodiment of a direct DC power transfer system 700 that includes battery-powered positive and negative contacts 702*a*, 702*b* of an external power supply 704 and corresponding positive and negative contacts 706*a*, 706*b* of a lighting device 708. The positive and negative contacts 706*a*, 706*b* of the lighting device 708 may provide power to a rechargeable battery (or capacitor) 710 and/or direct power to a light source (not shown). The external power supply 704 also includes a battery (or capacitor) 712 electronically coupled to the positive and negative contacts 702*a*, 702*b*. In this embodiment, the positive and negative contacts 702*a*, 702*b* of the external power supply 704 are provided by external wall surfaces 714*a*, 714*b* that are electronically isolated from each other and which make contact with corresponding distal and perimeter wall surfaces 716*a*, 716*b* of the lighting device 708. The distal and perimeter wall surfaces 716*a*, 716*b* are also electronically isolated from each other in this embodiment.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A lighting system for remote placement and powering of a lighting device, comprising:

the lighting device composed of:

a sconce body including a proximal side configured for placement adjacent to a wall or ceiling, a wall having an exterior surface and an interior surface, and an interior portion;

an inductive power receiver positioned at least partially within the interior portion of the sconce body, the inductive power receiver including an electromagnetic power receiver coil positioned in the interior portion of the sconce body adjacent to the interior surface of the wall for generating AC power in response to electromagnetic power applied thereto and an AC-to-DC power converter electronically coupled to the electromagnetic power receiver coil; and a light source on or adjacent to the sconce body;

an external power supply selectively attachable to and detachable from the lighting device, composed of:

a power supply body having an interior portion, a first exterior surface portion configured to lie adjacent to at least a portion of the exterior surface of the sconce body wall, and a second exterior surface portion;

a rechargeable battery or capacitor on or in the power supply body;

a DC-to-AC power inverter on or in the power supply body and in electrical communication with the rechargeable battery or capacitor; and an electromagnetic power generator coil in the interior portion of the power supply body adjacent to the first exterior surface portion and in electrical communication with the DC-to-AC power inverter; and an extension pole selectively attachable to and detachable from the external power supply.

2. The lighting system as in claim 1, wherein the sconce body wall comprises a distal wall portion spaced apart from the proximal side and a perimeter wall portion interconnecting and extending laterally between the proximal side and the distal wall portion.

3. The lighting system as in claim 2, wherein the distal wall portion and the perimeter wall portion of the sconce body wall form an angle, and wherein an inner surface of the power supply body comprises first and second walls that form a corresponding angle so that the first wall is configured to lie adjacent to the distal wall portion and the second wall is configured to lie adjacent to the perimeter wall portion of the scone body wall when the external power supply is selectively attached to the lighting device.

4. The lighting system as in claim 1, wherein the lighting device further comprises an onboard rechargeable battery or capacitor positioned in or adjacent to the sconce body, wherein the onboard rechargeable battery is electrically coupled to the AC-to-DC power converter and to the light source.

5. The lighting system as in claim 4, wherein the AC-to-DC power converter is electrically coupled to the light source to provide additional electrical power to the light source when the onboard rechargeable battery or capacitor has discharged or is not present.

6. The lighting system as in claim 1, wherein the external power supply further comprises a DC power input port for delivering DC power from an external power supply in order to recharge the rechargeable battery of the external power supply.

7. The lighting system as in claim 1, wherein the external power supply is selectively attachable to the lighting device by means of one or more magnets positioned on or in the sconce body and/or the power supply body.

8. The lighting system as in claim 7, wherein the exterior surface of the sconce body wall is substantially devoid of protrusions or recesses so as to provide a smooth face.

9. The lighting system as in claim 1, further comprising a second external power supply selectively attachable to and detachable from the lighting device for providing alternative or additional electrical power to the lighting device.

10. The lighting system as in claim 1, wherein the light source is pivotally attached to the sconce body so as to be angularly adjustable.

11. The lighting system as in claim 1, wherein the extension pole and/or power supply body comprise one or more of a protrusion, recess or magnet for selectively attaching and detaching the extension pole to and from the power supply body.

12. A lighting system for remote placement and powering of a lighting device, comprising:

the lighting device composed of:

a sconce body having a proximal side configured for placement adjacent to a wall or ceiling, a distal wall spaced apart from the proximal side, a perimeter wall interconnecting and extending laterally between the proximal side and the distal wall, and an interior portion, wherein the distal wall and the perimeter wall form an angle and provide an interior surface and an exterior surface of the sconce body;

an inductive power receiver positioned at least partially within the interior portion of the sconce body, the inductive power receiver including an electromagnetic power receiver coil positioned in the interior portion of the sconce body adjacent to the interior surface for generating AC power in response to electromagnetic power applied thereto and an AC-to-DC power converter electronically coupled to the electromagnetic power receiver coil; and a light source on or adjacent to the sconce body;

an external power supply selectively attachable to and detachable from the lighting device, composed of:

a power supply body having an interior portion, a first exterior surface portion defined by first and second walls that form a corresponding angle so that the first wall is configured to lie adjacent to at least a portion of the distal wall and the second wall is configured to lie adjacent to at least a portion of the perimeter wall of the scone body wall when the external power supply is selectively attached to the lighting device;

a rechargeable battery on or in the power supply body;

a DC-to-AC power inverter on or in the power supply body and in electrical communication with the rechargeable battery; and an electromagnetic power generator coil in the interior portion of the power supply body adjacent to the first exterior surface portion and in electrical communication with the DC-to-AC power inverter; and one more magnets positioned on or in the sconce body and/or the power supply body for selectively magnetic attaching or detaching the power supply body to or from the sconce body.

13. The lighting system as in claim 12, wherein the lighting device further comprises at least one onboard rechargeable battery or capacitor positioned in or adjacent to the sconce body, wherein the onboard rechargeable battery or capacitor is electrically coupled to the AC-to-DC power converter and to the light source.

14. The lighting system as in claim 13, wherein the AC-to-DC power converter is electrically coupled to the light source to provide additional electrical power to the light source when the onboard rechargeable battery or capacitor has discharged or is not present.

15. The lighting system as in claim 12, wherein the AC-to-DC power converter is electrically coupled to the light source to provide electrical power directly to the light source when the external power supply is attached to the sconce body.

16. The lighting system as in claim 12, further comprising at least one additional external power supply selectively attachable to and detachable from the lighting device for providing alternative or additional electrical power to the lighting device.

17. The lighting system as in claim 12, further comprising an extension pole selectively attachable to and detachable from the external power supply.

18. A lighting system for remote placement and powering of a lighting device, comprising:

the lighting device composed of:

a sconce body having a proximal side configured for placement adjacent to a wall or ceiling, a distal wall spaced apart from the proximal side, a perimeter wall interconnecting and extending laterally between the proximal side and the distal wall, and an interior portion, wherein the distal wall and the perimeter wall form an angle and provide an interior surface and an exterior surface of the sconce body;

an onboard rechargeable battery or capacitor positioned within the interior portion of the sconce body;

a light source on or adjacent to the sconce body and electrically coupled to the rechargeable battery; and power receiving means for receiving power from an external power supply and delivering DC electrical power to at least one of the rechargeable battery or capacitor or light source, wherein the power receiving means of the lighting device comprises first and second onboard electrical contacts in electrical communication with the onboard rechargeable battery, wherein the first onboard electrical contact is provided by the distal wall and the second onboard electrical contact is provided by the perimeter wall, wherein the distal wall and perimeter wall are electrically isolated from each other;

the external power supply selectively attachable to and detachable from the lighting device, composed of:

a power supply body having an interior portion, a first exterior surface portion defined by first and second walls that form a corresponding angle so that the first wall is configured to lie adjacent to at least a portion of the distal wall and the second wall is configured to lie adjacent to at least a portion of the perimeter wall of the scone body wall when the external power supply is selectively attached to the lighting device;

an external rechargeable battery on or in the power supply body; and power delivery means for delivering power to the power receiving means of the lighting device, the power delivery means of the external power supply comprises first and second external contacts in electrical communication with the external rechargeable battery, wherein the first external electrical contact is provided by the first wall and the second external electrical contact is provided by the second wall, wherein the first wall and second wall are electrically isolated from each other, and wherein the power delivery means delivers DC power to the power receiving means when the first wall of the power supply body is in electrical contact with the distal wall of the sconce body and the second wall of the power supply body is in electrical contact with the perimeter wall of the sconce body;

one more magnets positioned on or in the sconce body and/or the power supply body for selectively magnetic attaching or detaching the power supply body to or from the sconce body; and an extension pole selectively attachable to and detachable from the external power supply.

19. The lighting system as in claim 18, wherein:

the power receiving means of the lighting device comprises an inductive power receiver positioned at least partially within the interior portion of the sconce body, the inductive power receiver including an electromagnetic power receiver coil positioned in the interior portion of the sconce body adjacent to the interior surface for generating AC power in response to electromagnetic power applied thereto and an AC-to-DC power rectifier electronically coupled to the electromagnetic power receiver coil, and the power delivery means of the external power supply comprises a DC-to-AC power inverter on or in the power supply body and in electrical communication with the rechargeable battery and an electromagnetic power generator coil in the interior portion of the power supply body adjacent to the first exterior surface portion and in electrical communication with the DC-to-AC power inverter.

* * * * *

UNITED STATES PATENT AND TRADEMARK OFFICE

CERTIFICATE OF CORRECTION

PATENT NO. : 9,133,994 B2
APPLICATION NO. : 13/471628
DATED : September 15, 2015
INVENTOR(S) : Dowdy et al.

It is certified that error appears in the above-identified patent and that said Letters Patent is hereby corrected as shown below:

Drawings
On sheet 4 of 6 delete Fig. 4 and insert corrected drawing
On sheet 4 of 6 delete Fig. 5 and insert corrected drawing
On sheet 6 of 6 delete Fig. 7 and insert corrected drawing
FIG. 4, remove labeling of element 448
FIG. 5, change "570" to --510--
FIG. 5, remove labeling of element 118
FIG. 5, remove labeling of one of the right instance of element 520
FIG. 7, add labeling of element 708

Specification
Column 4
Line 35, change "batter" to --battery--

Signed and Sealed this
Twenty-second Day of March, 2016

Michelle K. Lee

Michelle K. Lee
*Director of the United States Patent and Trademark Office*